US007505707B2

(12) United States Patent
Makino

(10) Patent No.: US 7,505,707 B2
(45) Date of Patent: Mar. 17, 2009

(54) IMAGE FORMING UNIT AND IMAGE FORMING APPARATUS HAVING THE SAME TO WHICH STORAGE TRAYS HAVING VARIOUS STORAGE CAPACITIES CAN BE REMOVABLY ATTACHED

(75) Inventor: Kazumasa Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/589,911

(22) Filed: Oct. 31, 2006

(65) Prior Publication Data

US 2007/0041765 A1 Feb. 22, 2007

Related U.S. Application Data

(62) Division of application No. 10/811,975, filed on Mar. 30, 2004.

(30) Foreign Application Priority Data

Mar. 31, 2003 (JP) ..... 2003-093153

(51) Int. Cl.
*G03G 15/00* (2006.01)

(52) U.S. Cl. ..... 399/107; 399/110; 399/393

(58) Field of Classification Search ..... 399/107, 399/110, 391, 393; 271/9.01, 9.11, 145, 271/163, 164
See application file for complete search history.

(56) References Cited

U.S. PATENT DOCUMENTS 4,681,422 A 7/1987 Oba et al.
5,191,382 A * 3/1993 Okamura et al. ..... 399/107
5,224,693 A 7/1993 Taguchi et al.
5,625,444 A 4/1997 Suzuki et al.
5,678,814 A 10/1997 Yokoyama et al.
5,722,029 A 2/1998 Tomidokoro et al.
5,878,308 A 3/1999 Kurata et al.
5,950,046 A 9/1999 Goto
6,085,051 A * 7/2000 Miyasaka et al. ..... 399/393
6,123,329 A 9/2000 Sato et al.
6,185,388 B1 2/2001 Yamamoto
6,308,947 B1 10/2001 Kojima et al.

(Continued)

FOREIGN PATENT DOCUMENTS

JP A-1-172129 7/1989

(Continued)

*Primary Examiner*—David M Gray
*Assistant Examiner*—Laura K Roth
(74) *Attorney, Agent, or Firm*—Oliff & Berridge, PLC

(57) ABSTRACT

An image forming unit includes an image forming device that forms an image on a recording medium disposed at a lower portion thereof, a device frame that supports the image forming device at the lower portion, having a first attaching portion to which to attach a first storage frame and a second attaching portion to which to attach a second frame. Either a first storage unit or a second storage unit is attached to the image forming unit. The first storage unit includes a first storage tray having a first storage capacity, a first guide member and the first storage frame. The second storage unit includes a second storage tray having a second storage capacity larger than the first storage capacity, the second guide member and the second storage frame.

9 Claims, 8 Drawing Sheets

U.S. PATENT DOCUMENTS 6,612,763 B1 9/2003 Yoshihara

FOREIGN PATENT DOCUMENTS

JP A 5-17034 1/1993
JP A-10-120203 5/1998
JP A 10-142868 5/1998
JP A 10-239932 9/1998
JP A 2001-235993 8/2001

* cited by examiner

IMAGE FORMING UNIT AND IMAGE FORMING APPARATUS HAVING THE SAME TO WHICH STORAGE TRAYS HAVING VARIOUS STORAGE CAPACITIES CAN BE REMOVABLY ATTACHED

This is a Division of application Ser. No. 10/811,975 filed Mar. 30, 2004. The disclosure of the prior application is hereby incorporated by reference herein in its entirety.

BACKGROUND OF THE INVENTION

1. Field of the Invention

The present invention relates to an image forming unit for forming an image on a recording medium supplied from a storage tray, and an image forming apparatus having the image forming unit, and particularly relates to an image forming unit to which storage trays having various storage capacities can be removably attached in accordance with the need of users in spite of easiness in design or molding and reduction in cost, and an image forming apparatus having the image forming unit.

2. Background Art

An image forming apparatus such as a printer includes a process unit, a fixing unit, a scanner, and soon as a printing device. Under the printing device, a storage tray for storing sheets of paper as recording media is provided removably. The sheets of paper in the storage tray are fed one by one to an printing device by a paper supply roller disposed above the storage tray or other rollers. Thus, printing is performed on the sheets of paper.

In some of the printers configured thus, another optional tray unit can be additionally attached in accordance with the need of a user (see JP-A-5-17034, page 3 and FIG. 1). That is, the tray unit has another storage tray separate from the storage tray provided in the printer. When the tray unit is additionally attached to the printer, the paper storage capacity is increased so that the frequency of paper replenishment can be reduced.

In such a manner, the frequency of paper replenishment can be reduced by adding a tray unit suitably in accordance with the use conditions. To this end, however, users have to purchase tray units and attach them severally. To solve such labor, it can be therefore considered to manufacture and provide printers for a plurality of models different only in the paper storage capacity of the storage tray. Thus, users can choose printers in accordance with their needs respectively. This solution is very user-friendly because users do not have to purchase tray units and attach them severally.

Here, in order to design printers for a plurality of models different only in the paper storage capacity of the storage tray, configurations as shown in FIGS. 8A and 8B may be considered. FIGS. 8A and 8B are diagrams showing the overall configurations of the printers for a plurality of models different only in the paper storage capacity of the storage tray. First, a printer 500 shown in FIG. 8A has a printing device 50 such as a process unit, and a storage tray 506 lying under the printing device 50 and having a certain storage capacity. Both the printing device 50 and the storage tray 506 are supported by frames 552 from their opposite (left and right) sides. Tray guides 561 for supporting the storage tray 506 from the opposite (left and right) sides of the paper of FIG. 8A and supporting the weight of the printing device 50 are disposed between the storage tray 506 and the frames 552 respectively. A cover 553 is provided to cover the outsides of the frames 552.

On the other hand, a printer 600 shown in FIG. 8B has a storage tray 606 having a paper storage capacity larger than that of the storage tray 506 depicted in FIG. 8A. Further, the printer 600 has tray guides 661, a printing device 50 and frames 652 and a cover 653 in the same manner as the printer 500 depicted in FIG. 8A. That is, the tray guides 661 support the storage tray 606 from the opposite (left and right) sides of the paper of FIG. 8B and support the weight of the printing device 50. The frames 652 support the printing device 50 and the tray guides 661. The cover 653 is located outermost.

SUMMARY OF THE INVENTION

However, when printers for a plurality of models different only in the paper storage capacity of the storage tray are designed using the overall configurations shown in FIGS. 8A and 8B, the dimensions of each frame 552, 652 differ from one model to another. Thus, the frame 552, 652 has to be designed for each model or manufactured for each model. As a result, there occurs a problem that the manufacturing cost of the printers increases or the inventory control of the frames becomes complicated. The same things apply to the cover 553, 653.

An image forming unit is disclosed herein, to which storage trays having various storage capacities can be removably attached in accordance with the need of users in spite of easiness in design or molding and reduction in cost, and an image forming apparatus having the image forming unit.

According to one aspect of the invention, an image forming unit includes: an image forming device that forms an image on a recording medium supplied from a storage tray for storing recording media; a device frame that supports the image forming device; a first attaching portion that attaches a first storage frame of a first storage unit to the device frame, the first storage unit including a first storage tray, a first guide member and the first storage frame, the first storage tray having a first storage capacity and serving as the storage tray, the first guide member guiding the first storage tray, the first storage frame supporting the first guide member; and a second attaching portion that attaches a second storage frame of a second storage unit to the device frame, the second storage unit including a second storage tray, a second guide member and the second storage frame, the second storage tray having a second storage capacity larger than the first storage capacity and serving as the storage tray, the second guide member guiding the second storage tray, the second storage frame supporting the second guide member.

BRIEF DESCRIPTION OF THE DRAWINGS

The present invention may be more readily described with reference to the accompanying drawings.

DETAILED DESCRIPTION OF THE PREFERRED EMBODIMENTS

Preferred embodiments of the invention will be described below with reference to the drawings.

Figure 1A:
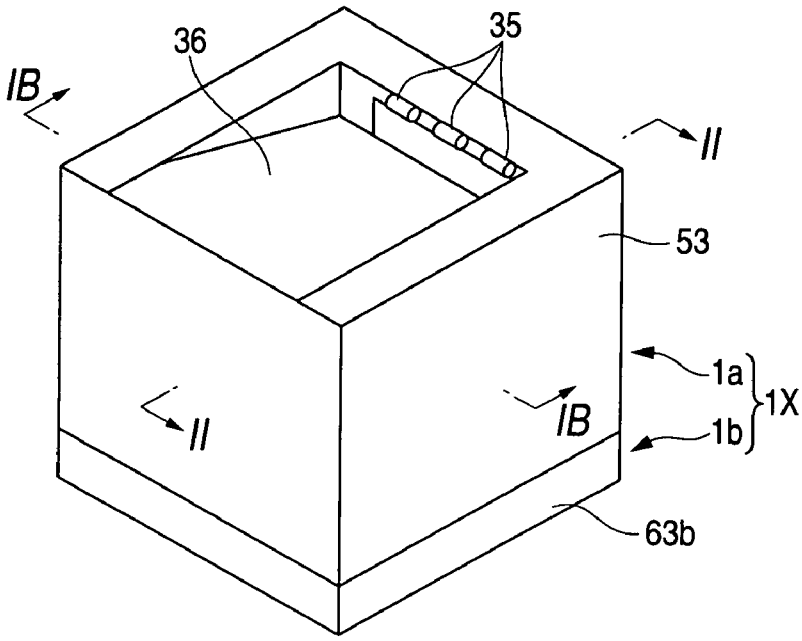
FIG. 1A is a schematic perspective view showing a laser printer in which a small tray has been attached to a printer unit according to a first embodiment of the invention.
Figure 1B:
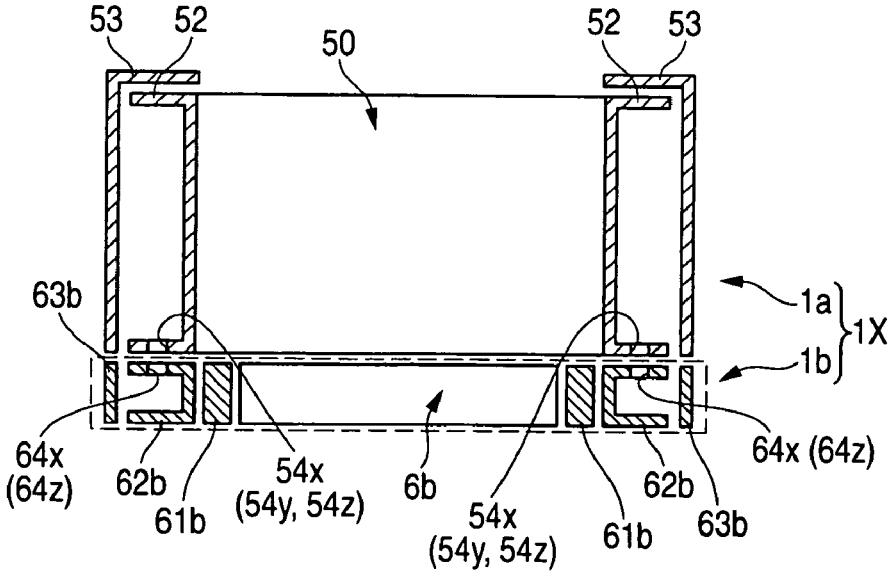
FIG. 1B is a schematic sectional view taken on line Ib-Ib in FIG. 1A.

First, a laser printer according to a first embodiment of the invention will be described with reference to FIGS. 1A, 1B, 2, 3A, 3B, 4A, 4B, 5A and 5B. FIG. 1A is a schematic perspective view showing the laser printer in which a small tray has been attached to a printer unit, as an example of an image forming unit, according to the first embodiment of the invention. FIG. 1B is a schematic sectional view taken on line Ib-Ib in FIG. 1A. As shown in FIGS. 1A and 1B, a laser printer 1X according to this embodiment is constituted by a printer unit 1*a* and a small tray unit 1*b* disposed under the printer unit 1*a*.

The printer unit 1*a* has a printing device 50, as an example of an image forming device, which will be described later with reference to FIG. 2, device frames 52 supporting the printing device 50 from the left and right sides of the paper of FIG. 1B, and a cover 53 disposed outside the device frames 52.

Figure 2:
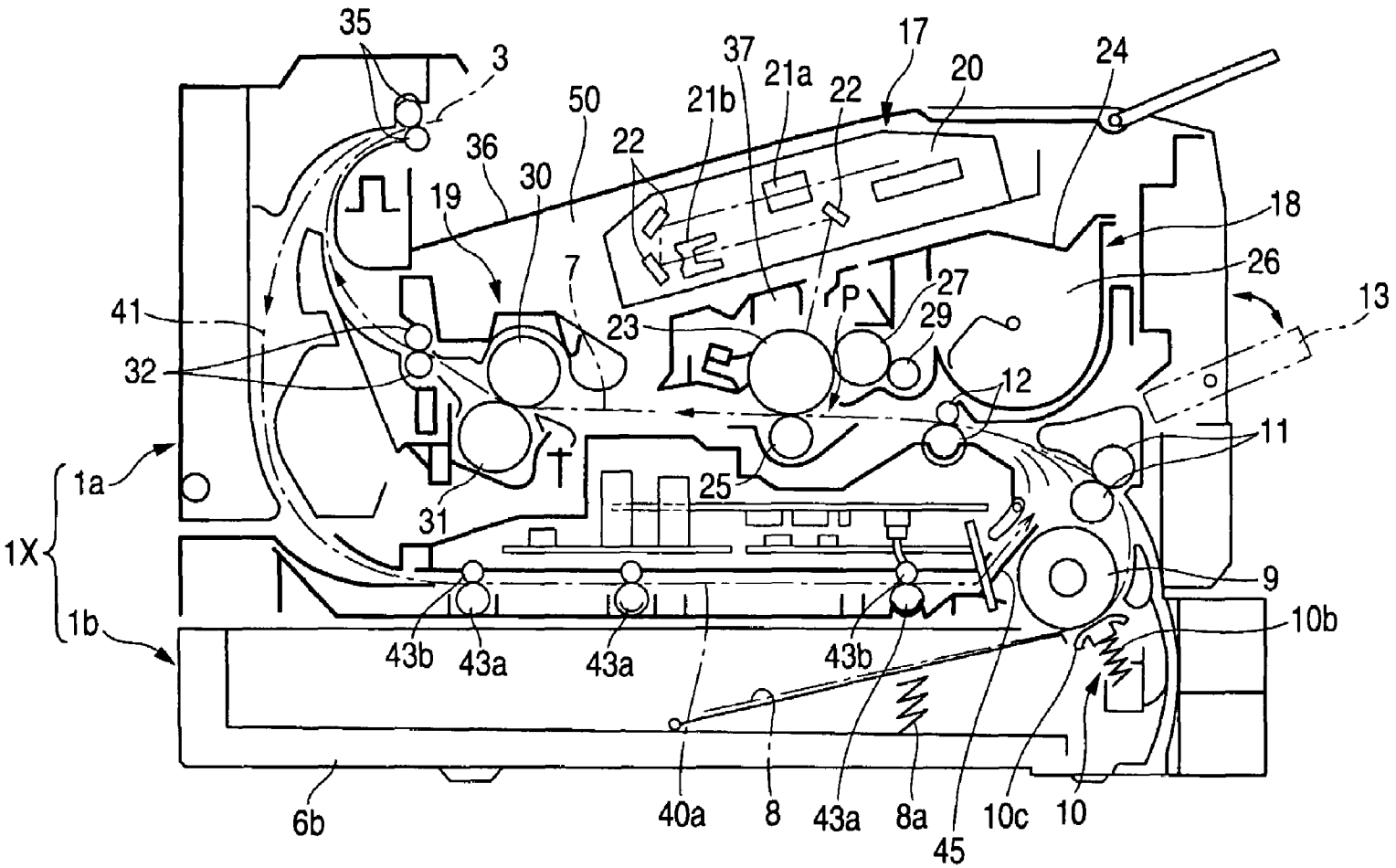
FIG. 2 is a sectional view taken on line II-II in FIG. 1A.

FIG. 2 is a sectional view taken on line II-II in FIG. 1A. The printing device 50 has a process unit 18, a scanner unit 17, a fixing unit 19 and so on as shown in FIG. 2. The process unit 18 forms a given image on a sheet of paper 3 supplied thereto. The fixing unit 19 fixes the image on the sheet of paper 3. Sheets of paper stored in the small tray unit 1*b* are taken out one by one by a paper supply roller 9 provided at the lower part of the printing device 50, and supplied to the process unit 18 and so on.

A feed path 7 of the sheet of paper 3 shown by the chain line in FIG. 2 is formed between the paper supply roller 9 and an image forming position P of the process unit 18 (a contact portion between a photoconductor drum 23 and a transfer roller 25 which will be described later, that is, a transfer position where a toner image on the photoconductor drum 23 is transferred to the sheet of paper 3). Between the paper supply roller 9 and the image forming position P, a feed roller pair 11 and a resist roller pair 12 are disposed in turn at a distance along the feed path 7. The sheets of paper 3 are sent to the feed roller pair 11 and the resist roller pair 12 in turn one by one, and corrected for skewing by the resist roller pair 12 as will be described later. After that, each sheet of paper 3 is sent to the image forming position P of the process unit 18.

On the downstream side of the feed roller pair 11 in the feed direction, a manual paper feed tray 13 for feeding the sheet of paper 3 manually is attached to be collapsible.

The scanner unit 17 is disposed above the process unit 18. The scanner unit 17 has a laser beam emitting portion (not shown), a polygon mirror 20 to be driven to rotate, lenses 21*a* and 21*b*, a reflecting mirror 22, etc. Then, a laser beam emitted from the laser beam emitting portion in accordance with given image data is passed through or reflected on the polygon mirror 20, the lens 21*a*, the reflecting mirror 22 and the lens 21*b* in that order. Thus, the surface of the photoconductor drum 23 serving as a photoconductor in the process unit 18 is scanned and irradiated with the laser beam at a high speed.

The process unit 18 is constituted by a drum cartridge, a developing cartridge 24, and so on. The drum cartridge includes the photoconductor drum 23, a Scorotron type charger 37 serving as a charging unit, the transfer roller 25 serving as a transfer unit, and so on. The developing cartridge 24 can be removably attached to the drum cartridge. The developing cartridge 24 has a toner storage portion 26, a developing roller 27 serving as a developing unit, a layer thickness limiting blade (not shown), a toner feed roller 29, etc.

The toner storage portion 26 is filled with polymer toner of one positive non-magnetic component as a developer. The toner is fed to the developing roller 27 by the toner feed roller 29. In this event, the toner is positively charged by friction between the toner feed roller 29 and the developing roller 27. Further, the toner fed onto the developing roller 27 is held as a thin layer with a constant thickness on the developing roller 27 due to rubbing of the layer thickness limiting blade with the rotation of the developing roller 27. On the other hand, the rotating photoconductor drum 23 is disposed to face the developing roller 27, and the drum body is grounded. In addition, the surface of the photoconductor drum 23 is formed out of a positive photoconductor layer made from an organic photoconductor material such as polycarbonate.

The Scorotron type charger 37 serving as a charging unit is disposed above the photoconductor drum 23 at a predetermined distance therefrom so as not to touch the photoconductor drum 23. The Scorotron type charger 37 is a positive charging Scorotron type charger that generates corona discharge from a charging wire of tungsten or the like. The Scorotron type charger 37 is designed to charge the surface of the photoconductor drum 23 positively uniformly.

The surface of the photoconductor drum 23 is, first, positively charged uniformly by the Scorotron type charger 37 with the rotation of the photoconductor drum 23. After that, the surface of the photoconductor drum 23 is exposed to a laser beam emitted from the scanner unit 17 and scanning the surface at a high speed. Thus, an electrostatic latent image is formed in accordance with given image data. Then, as soon as the toner held on the developing roller 27 and charged positively touches the photoconductor drum 23 in opposition thereto due to the rotation of the developing roller 27, the toner is supplied to the electrostatic latent image formed on the surface of the photoconductor drum 23, that is, to the exposed portion which is part of the surface of the photoconductor drum 23 positively charged uniformly and whose potential has been lowered due to the exposure to the laser beam. As a result, the toner is held selectively to be visualized. Thus, a toner image is obtained.

The transfer roller 25 is disposed under the photoconductor drum 23 so as to face the photoconductor drum 23. The transfer roller 25 has a roller shaft made from metal and coated with a roller made from an ion-conductive rubber material. A transfer bias (transfer forward bias) is applied from a transfer bias applying power source to the transfer roller 25 at the time of transfer. Thus, the toner image held on the surface of the photoconductor drum 23 is transferred to the sheet of paper 3 when the sheet of paper 3 passes between the photoconductor drum 23 and the transfer roller 25.

The fixing unit 19 is disposed on the downstream side of the process unit 18 along the feed path 7. The fixing unit 19 has a heating roller 30, a pressure roller 31 disposed to press the heating roller 30, and a feed roller pair 32 provided on the downstream side of the rollers 30 and 31. The heating roller 30 is made from metal such as aluminum, and provided with a heater such as a halogen lamp for heating so that the toner transferred onto the sheet of paper 3 in the process unit 18 is fixed thermally when the sheet of paper 3 passes between the heating roller 30 and the pressure roller 31. After that, the sheet of paper 3 is carried to the position of a paper delivery roller pair 35 by the feed roller pair 32. The sheet of paper 3 subjected to print processing completely is delivered onto a paper outlet tray 36 by the rotation of the paper delivery roller pair 35.

The laser printer 1 according to this embodiment can perform double-sided printing on the sheet of paper 3. A choice of delivering the sheet of paper 3 fed to the paper delivery roller pair 35 as described above or performing print processing on the other side of the sheet of paper 3 again can be made on the laser printer 1.

Here, description will be made on the double-sided printing by the laser printer 1. When the double-sided printing is set, the front and back of the sheet of paper fed to the paper delivery roller pair 35 after single-sided printing are reversed due to the reverse rotation of the paper delivery roller pair 35. In this state, the sheet of paper is fed toward the resist roller pair 12 again along a reverse path 41 and a refeed path 40*a* following the reverse path 41. In the refeed path 40*a*, the sheet of carried is fed while being held between a plurality of pairs of refeed rollers 43*a* and 43*b* disposed at a distance from one another, and fed to the resist roller pair 12 through a refeed guide 45. Then sheet of paper is subjected to printing on the other unprinted side thereof by the process unit 18. The sheet of paper after the double-sided printing is delivered onto the paper outlet tray 36 due to the rotation of the paper delivery roller 35 as described above.

Incidentally, the device frames 52 shown in FIG. 1B are disposed on the opposite sides of the printing device 50 in the direction vertical to the paper of FIG. 2, so as to support the printing device 50.

Each device frame 52 is made of a plate-like member, whose opposite end portions in the height direction are bent outside at right angles so as to make the length of the device frame 52 in the height direction is substantially equal to that of the printing device 50. Thus, as shown in FIG. 1B, the device frame 52 is formed into a U-shape in sectional view. Then, in the lower bent surface of the device frame 52, three threaded holes 54*x*, 54*y* and 54*z* are provided to extend in the direction vertical to the paper of FIG. 1B (see FIG. 4A). The threaded holes 54*x*, 54*y* and 54*z* are used for attaching a guide frame of a tray unit to the device frame 52. Further in the lower bent surface, a protrusion portion 56 is provided to project downward in the vertical direction.

The cover 53 is made of a plate-like member, whose upper end is bent inside at right angles so as to cover the outsides of the device frames 52, while the lower end of the cover 53 is formed not to project from the printing device 50 or the device frames 52. That is, the length of the cover 53 in the height direction is substantially equal to that of each device frame 52 (See FIG. 4A).

In addition, the small tray unit 1*b* disposed under the printer unit 1*a* includes a small tray 6*b*, small tray guides 61*b*, small guide frames 62*b*, and a small unit cover 63*b*. The small tray 6*b* can store 250 sheets of paper as recording media. The small tray guides 61*b* support the small tray 6*b* from the left and right sides of the paper of FIG. 1B. The small guide frames 62*b* support the small tray guides 61*b* further outside the small tray guides 61*b* respectively. The small unit cover 63*b* is disposed outermost.

The small tray 6*b* is a box-like tray open at the top. The small tray 6*b* is supported under the printing device 50 and between the two tray guides 61*b* removably in the downward direction of the paper of FIG. 1B. As shown in FIG. 2, a paper pressure plate 8, a separation pad unit 10, and soon, are provided in the small tray 6*b*. The separation pad unit 10 is provided in a lower portion of one side end portion of the small tray 6*b*.

The paper pressure plate 8 has a top on which the sheets of paper 3 can be stacked, and a bottom urged upward by a spring 8*a*. In addition, the paper pressure plate 8 is supported swingably at one end more distant from the paper supply roller 9 provided in the printer unit 1*a*. Thus, the other end closer to the paper supply roller 9 can move in the up/down direction.

The separation pad unit 10 is disposed to face the paper supply roller 9. A separation pad (not shown) made from a member having a high friction drag is pressed toward the paper supply roller 9 by a spring 10*b* disposed on the back side of a pad backing 10*c* in the separation pad unit 10.

The separation pad and the paper supply roller 9 provided in the printer unit 1*a* are formed so that the width in a direction perpendicular to the feed direction of the sheet of paper 3 is shorter than the width of the sheet of paper 3. In addition, the separation pad and the paper supply roller 9 are disposed to come in contact with only the substantially widthwise central portion of the sheet of paper 3 when the sheet of paper 3 is fed.

Incidentally, the small tray guides 61*b* or the small guide frames 62*b* shown in FIG. 1B are disposed on the opposite sides of the small tray 6*b* in the direction vertical to the paper of FIG. 2, so as to support the small tray 6*b*.

Each small tray guide 61*b* is constituted by two substantially rectangular parallelepiped members disposed at a distance in the direction vertical to the paper of FIG. 1B. The small tray guides 61*b* support the small tray 6*b* from the left and right sides of the paper of FIG. 1B, while bearing the weight of the printer unit 1*a* in the height direction.

Each small guide frame 62*b* is made of a plate-like member, whose opposite end portions in the height direction are bent outside at right angles in the same manner as the device frame 52. Thus, the small guide frame 62*b* is formed into a U-shape in sectional view, while the height of the small guide frame 62*b* is substantially equal to that of each small tray guide 61*b* or the small tray 6*b*. Then, in the upper bent surface of the small guide frame 62*b*, two threaded holes 64*x* and 64*z* are provided to extend in the direction vertical to the paper of FIG. 1B (see FIG. 4A). The bent surface of the small guide frame 62*b* provided with the threaded holes 64*x* and 64*z* is disposed to face the lower bent surface of the device frame 52 provided with the threaded holes 54*x*, 54*y* and 54*z* so that the threaded holes 54*x* and 54*z* of the device frame 52 correspond to the threaded holes 64*x* and 64*z* of the small guide frame 62*b* respectively. Further, in the upper bent surface of the small guide frame 62*b*, an insertion hole 66*b* to which the protrusion portion 56 formed in the lower bent surface of the device frame 52 can be inserted is provided (See FIG. 4A).

The small unit cover 63*b* is made of a plate-like member substantially as long in the height direction as each small guide frame 62*b*, and disposed under each cover 53 as shown in FIG. 1B.

That is, the laser printer 1X has a printer unit 1*a* and a small tray unit 1*b* supported by different frames respectively, and the small tray unit 1*b* is removable from the printer unit 1*a*. Accordingly, when the small tray unit 1*b* in the laser printer 1X is replaced by a large tray unit 1*c* having a larger storage capacity (capable of storing 500 sheets of paper), the large tray unit 1*c* can be attached to the printer unit 1*a* (see FIGS. 3A and 3B). That is, the laser printer 1X having a paper storage capacity of 250 sheets as shown in FIGS. 1A and 1B and a laser printer 1Y having a paper storage capacity of 500 sheets as shown in FIGS. 3A and 3B can be provided by use of the printer unit 1*a* according to this embodiment.

Figure 3A:
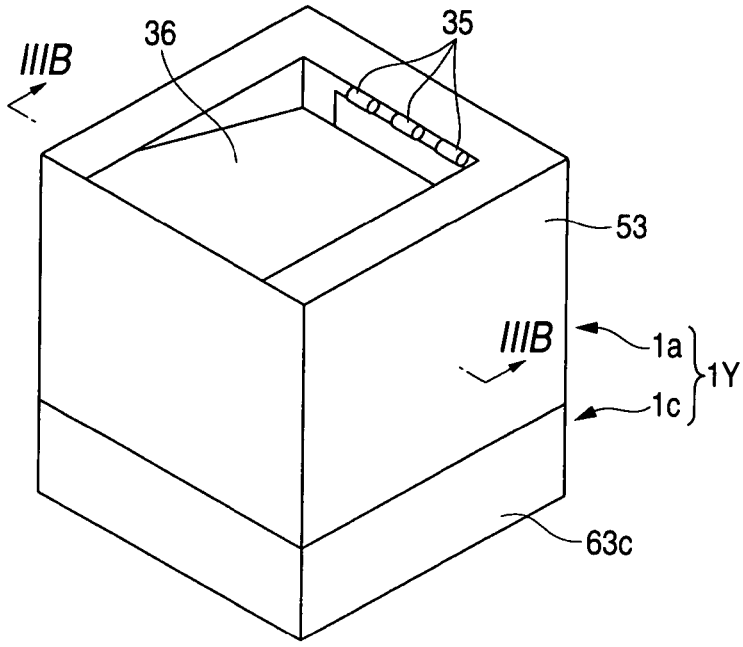
FIG. 3A is a schematic perspective view showing a laser printer in which a large tray having a storage capacity larger than that of the small tray has been attached to the printer unit depicted in FIG. 1A.
Figure 3B:
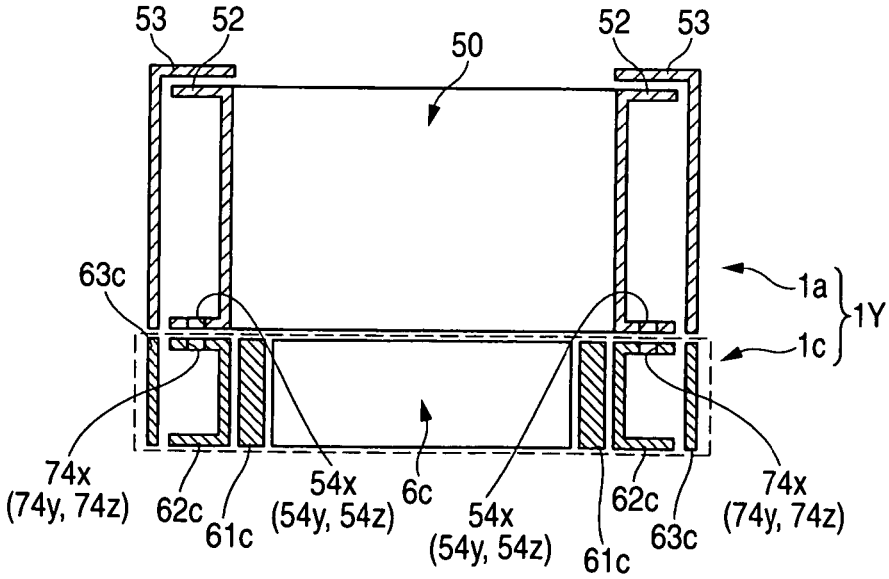
FIG. 3B is a schematic sectional view taken on line IIIb-IIIb in FIG. 3A.

FIG. 3A is a schematic perspective view showing a laser printer in which a large tray having a storage capacity larger than that of the small tray has been attached to the printer unit in FIG. 1A. FIG. 3B is a schematic sectional view taken on line III-III in FIG. 3A. The laser printer 1Y shown in FIGS. 3A and 3B is constituted by the printer unit 1*a* and a large tray unit 1*c* disposed under the printer unit 1*a*. Members constituting the large tray unit 1*c* are similar to those of the small tray unit 1*b* described above, but different therefrom in size. That is, the heights of a large tray 6*c*, large tray guides 61*c*, large guide frames 62*c* and a large unit cover 63*c* constituting the large tray unit 1*c* are substantially twice as large as the heights of the small tray 6*b*, the small tray guides 61*b*, the small guide frames 62*b* and the small unit cover 63*b* constituting the small tray unit 1*b* shown in FIG. 1B, respectively.

Figure 4A:
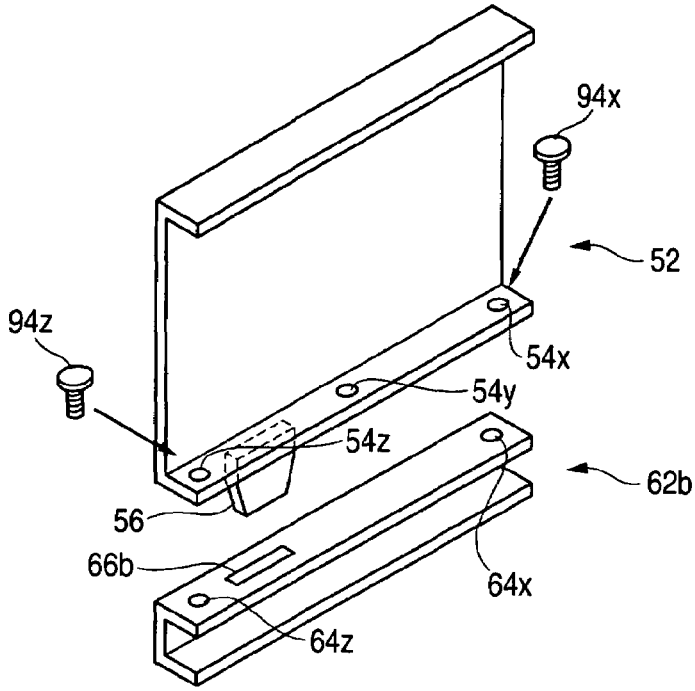
FIG. 4A is a perspective view showing a method for attaching a small guide frame to a device frame depicted in FIG. 1B.
Figure 4B:
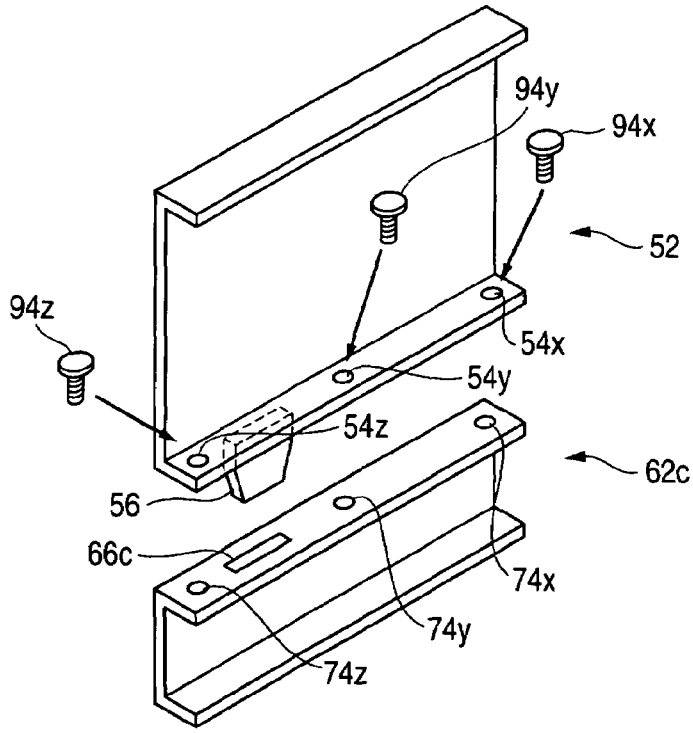
FIG. 4B is a perspective view showing a method for attaching a large guide frame to the device frame depicted in FIG. 3B.

In addition, while the two threaded holes 64*x* and 64*z* are provided in the upper bent surface of each small guide frame 62*b*, three threaded holes 74*x*, 74*y* and 74*z* are provided in the upper bent surface of each large guide frame 62*c* (see FIGS. 4A and 4B). As shown in FIG. 4B, the threaded holes 54*x*, 54*y* and 54*z* of the device frame 52 correspond to the threaded holes 74*x*, 74*y* and 74*z* of the large guide frame 62*c* respectively. Further, in the upper bent surface of the large guide frame 62*c*, an insertion hole 66*c* to which the protrusion portion 56 formed in the lower bent surface of the device frame 52 can be inserted is provided.

FIG. 4A is a perspective view showing a method for attaching the small guide frame 62*b* to the device frame 52 in FIG. 1B. FIG. 4B is a perspective view showing a method for attaching the large guide frame 62*c* to the device frame 52 in FIG. 3B.

To attach the small guide frame 62*b* to the device frame 52, as shown in FIG. 4A, the protrusion portion 56 of the device frame 52 is inserted into the insertion hole 66*b* of the small guide frame 62*b* while the threaded holes 54*x* and 54*z* are aligned with the threaded holes 64*x* and 64*z* respectively. Then, while the lower bent surface of the device frame 52 is brought into contact with the upper bent surface of the small guide frame 62*b*, screws 94*x* and 94*z* are screwed down to the threaded holes 54*x* and 54*z* respectively. Thus, the device frame 52 and the small guide frame 62*b* are fixed to each other.

To attach the large guide frame 62*c* to the device frame 52, as shown in FIG. 4B, the protrusion portion 56 of the device frame 52 is inserted into the insertion hole 66*c* of the large guide frame 62*c* while the threaded holes 54*x*, 54*y* and 54*z* are aligned with the threaded holes 74*x*, 74*y* and 74*z* respectively. Then, while the lower bent surface of the device frame 52 is brought into contact with the upper bent surface of the large guide frame 62*c*, screws 94*x*, 94*y* and 94*z* are screwed down to the threaded holes 54*x*, 54*y* and 54*z* respectively. Thus, the device frame 52 and the large guide frame 62*c* are fixed to each other.

That is, of the three threaded holes 54*x*, 54*y* and 54*z* in the device frame 52, the two threaded holes 54*x* and 54*z* excluding the central threaded hole 54*y* are used for attaching the small guide frame 62*b* while all the three threaded holes 54*x*, 54*y* and 54*z* are used for attaching the large guide frame 62*c*. This is because the large tray unit 1*c* is larger in weight than the small tray unit 1*b* so that the large tray unit 1*c* must be able to bear its own gravity when the laser printer 1Y is lifted up.

Figure 5A:
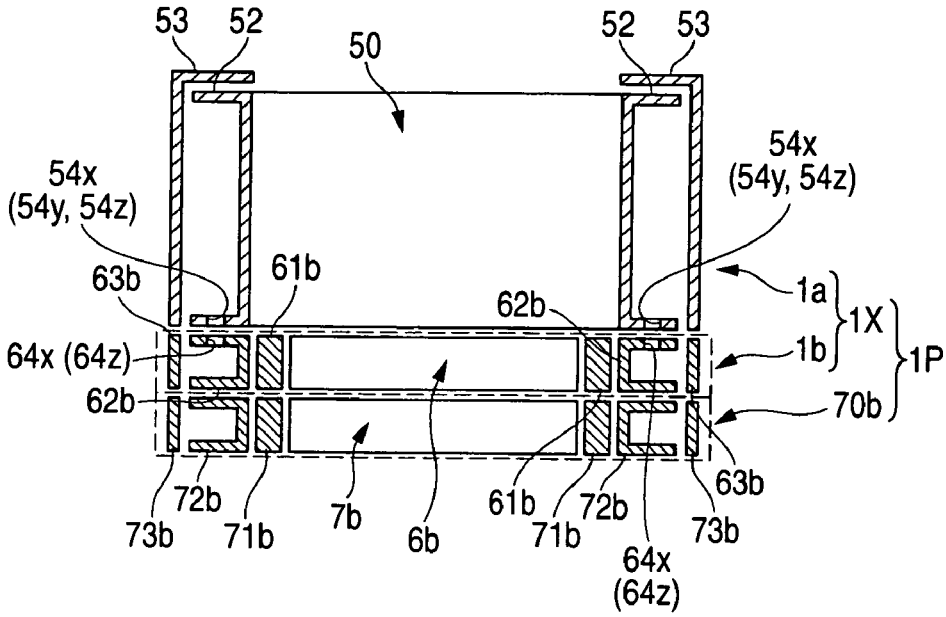
FIG. 5A is a schematic sectional view showing the state where an optional small tray unit has been mounted on the laser printer depicted in FIG. 1B.
Figure 5B:
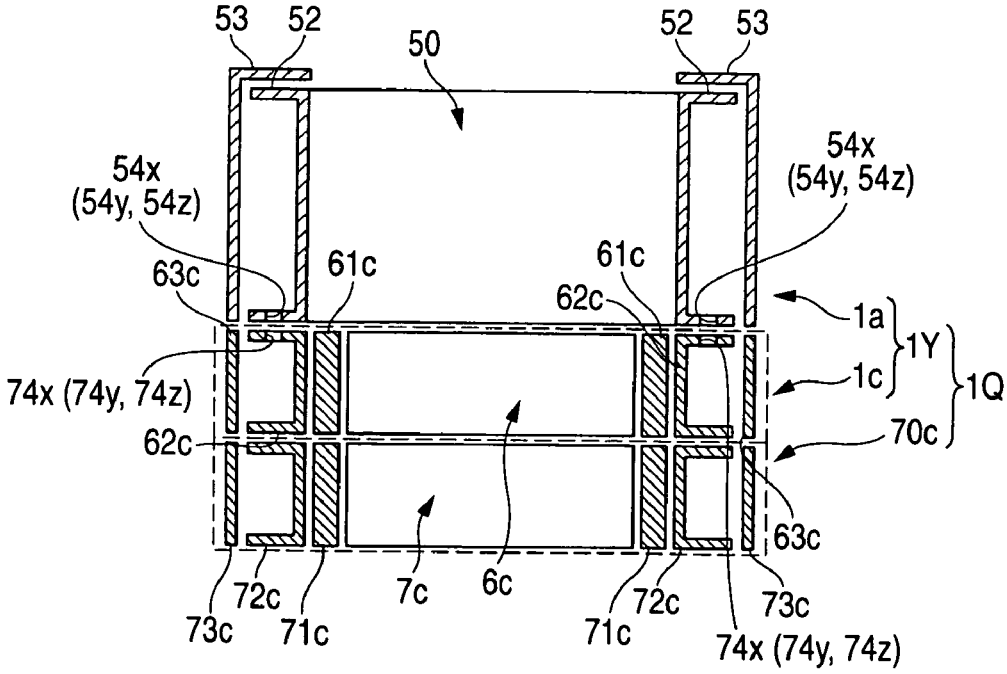
FIG. 5B is a schematic sectional view showing the state where an optional large tray unit has been mounted on the laser printer depicted in FIG. 3B.

Incidentally, another optional tray unit can be additionally mounted on the laser printer 1X, 1Y according to this embodiment. FIG. 5A is a schematic sectional view showing the state where an optional small tray unit 70*b* has been mounted on the laser printer 1X in FIG. 1B. FIG. 5B is a schematic sectional view showing the state where an optional large tray unit 70*c* has been mounted on the laser printer 1Y in FIG. 3B.

The optional small tray unit 70*b* mounted under the laser printer 1X as shown in FIG. 5A has a small tray 7*b*, small tray guides 71*b*, small guide frames 72*b*, and an optional small unit cover 73*b*. The small tray 7*b* can store 250 sheets of paper in the same manner as the small tray 6*b* of the small tray unit 1*b*. The small tray guides 71*b* support the small tray 7*b*. The small guide frames 72*b* support the small tray guides 71*b* respectively. The optional small unit cover 73*b* is disposed outermost. The two small trays 6*b* and 7*b* are supported by the frames 62*b* and 72*b* different from the device frames 52 respectively, and the tray guides 61*b* and 71*b* or the covers 63*b* and 73*b* are also separate from each other.

The optional large tray unit 70*c* mounted under the laser printer 1Y as shown in FIG. 5B has a large tray 7*c*, large tray guides 71*c*, large guide frames 72*c*, and an optional large unit cover 73*c*. The large tray 7*c* can store 500 sheets of paper in the same manner as the large tray 6*c* of the large tray unit 1*c*. The large tray guides 71*c* support the large tray 7*c*. The large guide frames 72*c* support the large tray guides 71*c* respectively. The optional large unit cover 73*c* is disposed outermost. The two large trays 6*c* and 7*c* are supported by the frames 62*c* and 72*c* different from the device frames 52 respectively, and the tray guides 61*c* and 71*c* or the covers 63*c* and 73*c* are also separate from each other.

Incidentally, the optional large tray unit 70*c* capable of storing 500 sheets of paper may be additionally mounted on the laser printer 1X shown in FIG. 5A, or the optional small tray unit 70*b* capable of storing 250 sheets of paper may be additionally mounted on the laser printer 1Y shown in FIG. 5B.

As described above, the printer unit 1*a* according to this embodiment does not include any tray 6*b*, 6*c* as its constituent component, but has the threaded holes 54*x* to 54*z* such that the small tray 6*b* and the large tray 6*c* having storage capacities different from each other can be selectively mounted on the printer unit 1*a*. Accordingly, only by attaching the small tray 6*b* or the large tray 6*c* to the printer unit 1*a*, it is possible to provide the laser printers 1X and 1Y for a plurality of models different only in the paper storage capacity of the tray while curbing the cost. That is, it is possible to realize the laser printers 1X and 1Y to which the trays 6*b* and 6*c* having various storage capacities can be removably attached in accordance with the need of users in spite of easiness in design or molding and reduction in cost.

In addition, of the three threaded holes 54*x*, 54*y* and 54*z* provided in the device frame 52, the two threaded holes 54*x* and 54*z* are used for attaching the small guide frame 62*b* of the small tray unit 1*b* while all the three threaded holes 54*x* to

54*z* are used for attaching the large guide frame 62*c* of the large tray unit 1*c*. That is, the threaded holes for the small guide frame 62*b* are included in the threaded holes for the large guide frame 62*c*. In this case, the work for attaching the frame when the laser printer 1X, 1Y is manufactured is easier than in the case where threaded holes for the small guide frame 62*b* are provided separately from threaded holes for the large guide frame 62*c*.

In addition, since the device frame 52 has the protrusion portion 56 capable of being engaged with the guide frame 62*b*, 62*c*, the work for attaching the frame when the laser printer 1X, 1Y is manufactured is easier than in the case where only the threaded holes 54*x* to 54*z* are provided.

In addition, the height-direction length of the cover 53 disposed outside the device frames 52 is substantially equal to that of each device frame 52, and the cover 53 is included in the printer unit 1*a* without reaching the area of the tray unit 1*b*, 1*c*. It is therefore unnecessary to exchange the cover 53 when the tray 6*b*, 6*c* is replaced. For example, assume that the cover is longer than the device frame 52. In such a case, when the small tray 6*b* is replaced by the large tray 6*c*, the cover must be exchanged for another larger one correspondingly to the tray size. In the configuration according to this embodiment, however, the cover 53 is designed to cover the whole of each device frame 52. When the size of a tray is larger than that of the cover 53, the shortage of the length of the cover 53 may be covered by the cover 63*b*, 63*c* provided additionally. That is, the labor or time for exchanging the cover whenever the tray 6*b*, 6*c* is changed is saved. Thus, according to the printer unit 1*a* including the cover 53 in this configuration, it is possible to provide the laser printers 1X and 1Y for a plurality of models different only in the paper storage capacity of the tray 6*b*, 6*c* while curbing the cost further.

In addition, the printer unit 1*a* according to this embodiment further includes the paper supply roller 9 for making contact with the sheet of paper 3 stored in the tray 6*b*, 6*c*, and feeding the sheet of paper 3 in contact to the process unit 1B by means of axial rotation. It is therefore unnecessary to provide the paper supply roller 9 for each individual tray 6*b*, 6*c* that can be removably attached to the printer unit 1*a*. Accordingly, by use of the printer unit 1*a* configured thus, it is possible to provide the laser printer 1X, 1Y while curbing the cost.

Figure 6A:
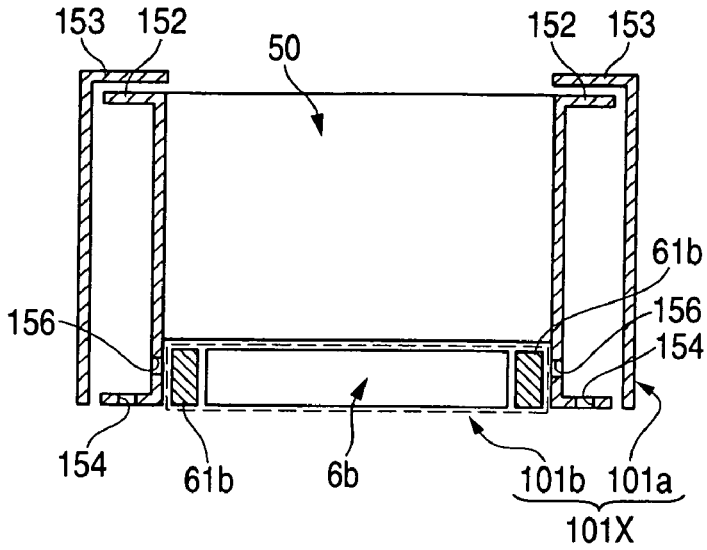
FIG. 6A is a schematic sectional view corresponding to FIG. 1B and showing a laser printer in which a small tray has been attached to a printer unit according to a second embodiment of the invention.
Figure 6B:
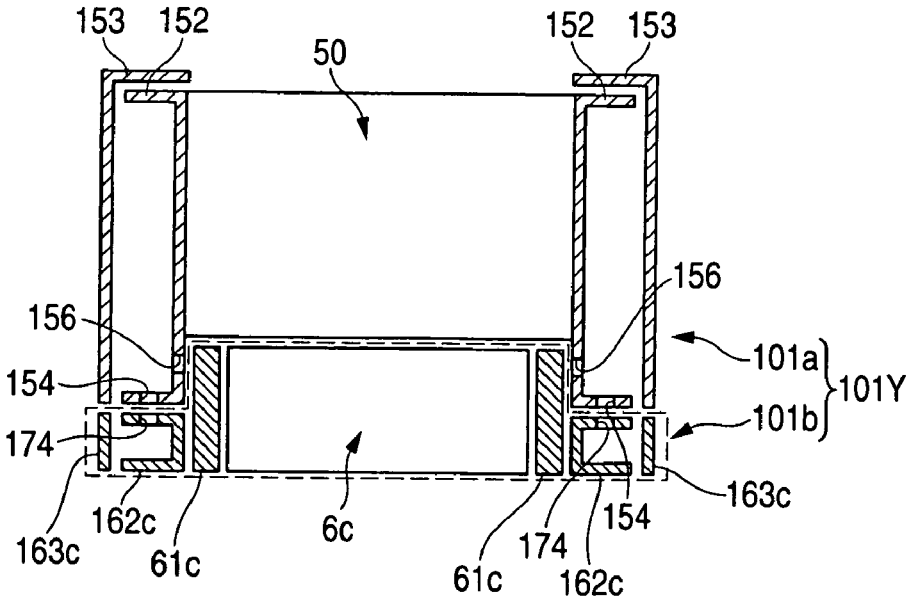
FIG. 6B is a schematic sectional view corresponding to FIG. 3B and showing a laser printer in which a large tray having a storage capacity larger than that of the small tray has been attached to the printer unit depicted in FIG. 6A.

Next, a laser printer according to the second embodiment of the invention will be described with reference to FIGS. 6A and 6B. Incidentally, parts similar in structure to those in the first embodiment will be denoted by the same reference numerals correspondingly, and their description will be omitted. FIG. 6A is a schematic sectional view corresponding to FIG. 1B and showing a laser printer in which a small tray has been attached to a printer unit according to the second embodiment of the invention. FIG. 6B is a schematic sectional view corresponding to FIG. 3B and showing a laser printer in which a large tray having a storage capacity larger than that of the small tray has been attached to the printer unit in FIG. 6A.

As shown in FIG. 6A, a laser printer 101X according to this embodiment is constituted by a printer unit 101*a* and a small tray section 101*b* disposed under the printer unit 101*a*. The small tray section 101*b* is constituted by a small tray 6*b* and small tray guides 61*b*. That is, the small tray section 101*b* is equivalent to one obtained by omitting the small guide frames 62*b* and the small unit cover 63*b* from the small tray unit 1*b* according to the first embodiment shown in FIG. 1B.

Each device frame 152 of the printer unit 101*a* according to this embodiment is different from the device frame 52 in the first embodiment shown in FIG. 1B. The device frame 152 projects downward from the printing device 50 and reaches the bottom portion of the small tray 6*b* or the small tray guide 61*b*. That is, the device frame 152 supports not only the printing device 50 but also the small tray section 101*b*. More in particular, the device frame 152 has at least one threaded hole 156 in lower portion of the support surface supporting the printing device 50 and so on and facing the small tray guide 61*b*. A screw (not shown) is screwed down to the threaded hole 156. Thus, the small tray guide 61*b* is attached to the device frame 152.

The lower bent surface of each device frame 152 has at least one threaded hole 154 similar to the threaded hole 54*x*-54*z* in the first embodiment shown in FIGS. 4A and 4B. The threaded hole 154 is used for attaching a large guide frame 162*c* of a large tray unit 101*c* shown in FIG. 6B.

The large tray unit 101*c* in this embodiment is constituted by a large tray 6*c* and large tray guides 61*c* similar to those of the large tray unit 1*c* in the first embodiment shown in FIG. 3B, and large guide frames 162*c* and a large unit cover 163*c* which are approximately half as high as the large guide frames 62*c* and the large unit cover 63*c*. The upper bent surface of each large guide frame 162*c* is provided with at least one threaded hole 174 similar to the threaded hole 74*x*-74*z* in the first embodiment.

Thus, the printer unit 101*a* and the large tray unit 101*c* are fixed to each other by screwing a screw (not shown) down to the threaded hole 156 to thereby attach each large tray guide 61*c* to the corresponding device frame 152, and screwing a screw (not shown) down to the threaded holes 154 and 174 to thereby attach each large guide frame 162*c* to the corresponding device frame 152. Incidentally, the large guide frame 162*c* and the large tray guide 61*c* may be fixed to each other or not fixed to each other.

That is, since the printer unit 101*a* according to this embodiment has the threaded holes 156 and 154, the small tray guides 61*b* of the small tray section 101*b* can be attached to the printer unit 101*a*, or the large tray guides 61*c* and the large guide frames 162*c* of the large tray unit 101*c* can be attached to the printer unit 101*a*. Thus, the laser printer 101X having a paper storage capacity of 250 sheets as shown in FIG. 6A and a laser printer 101Y having a paper storage capacity of 500 sheets as shown in FIG. 6B can be provided by use of the printer unit 101*a* according to this embodiment.

Incidentally, another optional tray unit can be additionally attached to the laser printer 101X, 101Y according to this embodiment, in the same manner as that shown in FIGS. 5A and 5B.

As described above, the printer unit 101*a* according to this embodiment does not include any tray 6*b*, 6*c* as its constituent component, but has the threaded holes 154 and 156 such that the small tray 6*b* and the large tray 6*c* having storage capacities different from each other can be selectively mounted. Accordingly, only by attaching the small tray 6*b* or the large tray 6*c* to the printer unit 101*a*, it is possible to provide the laser printers 101X and 101Y for a plurality of models different only in the paper storage capacity of the tray while curbing the cost. That is, in the same manner as in the first embodiment, it is possible to realize an image forming apparatus to which storage trays having various storage capacities can be removably attached in accordance with the need of users in spite of easiness in design or molding and reduction in cost.

Generally, in order to secure rigidity in a printer unit, it is preferable that the size of each device frame is increased. As another effect of this embodiment, it can be therefore noted that the embodiment is advantageous in securing rigidity because the size of each device frame 152 becomes large enough to support the small tray section 101*b*.

Figure 7A:
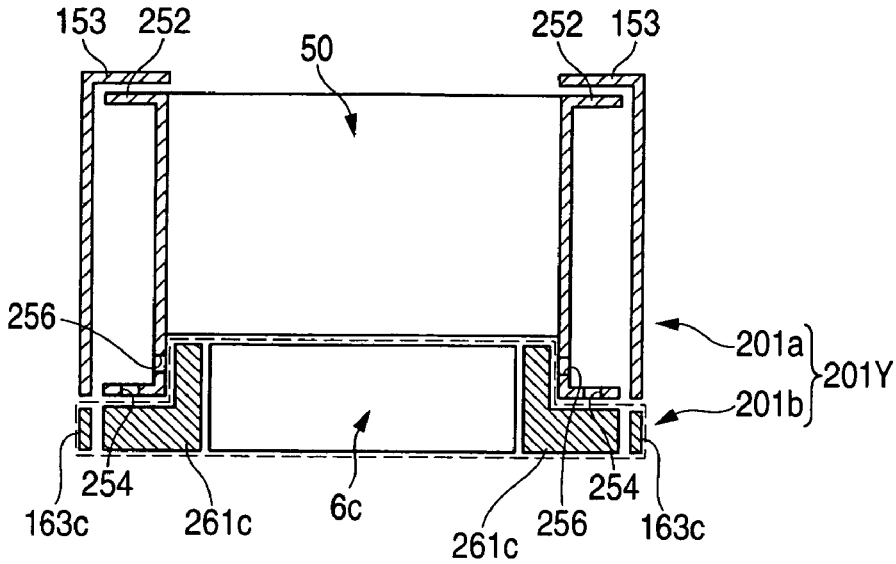
FIG. 7A is a schematic sectional view showing a modification of the laser printer depicted in FIG. 6B.
Figure 7B:
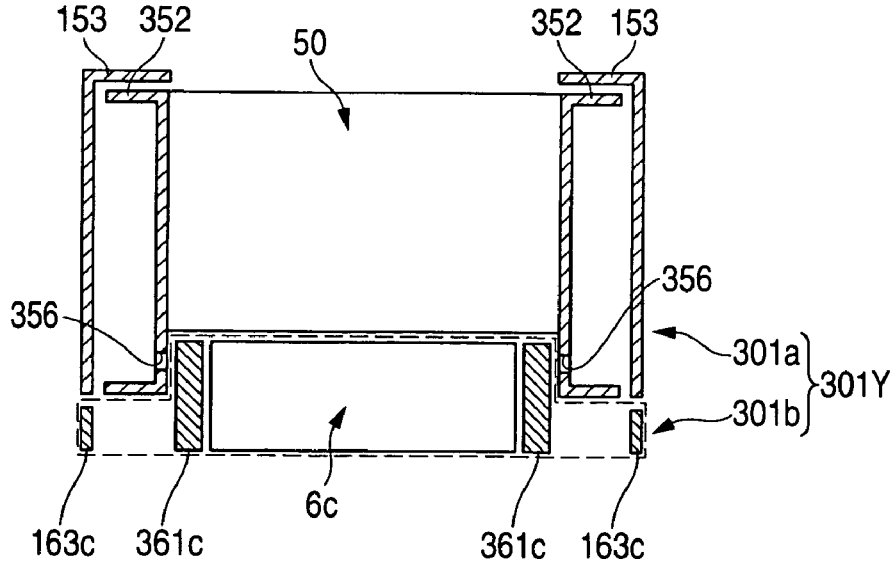
FIG. 7B is a schematic sectional view showing a modification of the laser printer depicted in FIG. 6B.
Figure 8A:
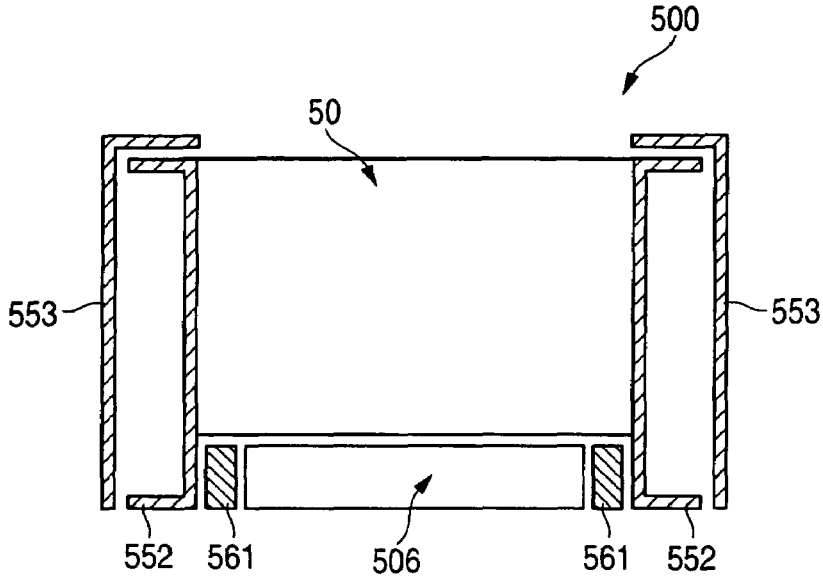
FIG. 8A is a schematic sectional view showing a laser printer in the background art.
Figure 8B:
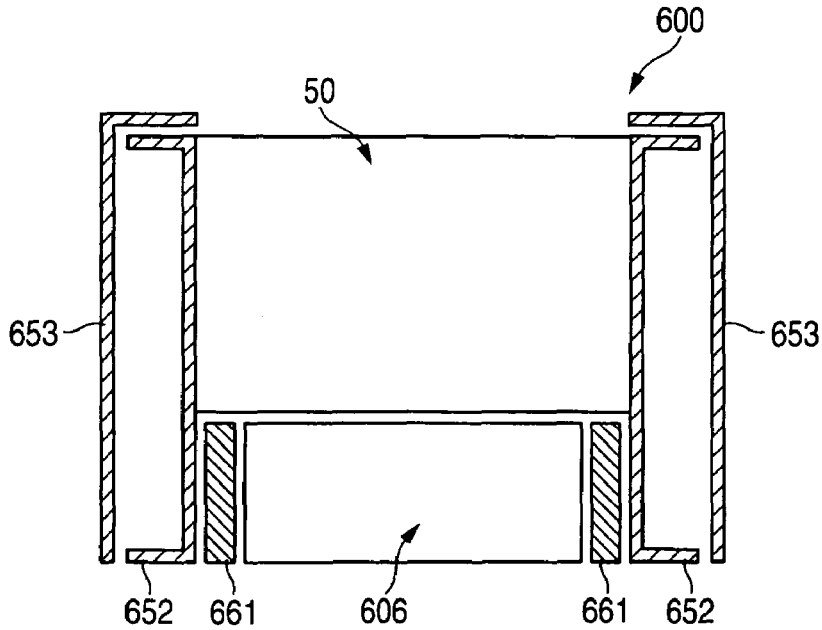
FIG. 8B is a schematic sectional view showing a laser printer in the background art having a storage tray with a paper storage capacity larger than that in FIG. 8A.

Next, modifications of the laser printer in FIG. 6B will be described with reference to FIGS. 7A and 7B. FIGS. 7A and 7B are schematic sectional views showing modifications of the laser printer in FIG. 6B. Each laser printer 201Y, 301Y shown in FIGS. 7A, 7B has a large tray 6*c* having a paper storage capacity of 500 sheets.

The laser printer 201Y in FIG. 7A has a printer unit 201*a* substantially similar to the printer unit 101*a* shown in FIGS. 6A and 6B. Threaded holes 254 and 256 similar to the threaded holes 154 and 156 shown in FIGS. 6A and 6B are provided in each device frame 252 of the printer unit 201*a*. While the threaded hole 154 is used for attaching the large guide frame 162*c*, the threaded hole 254 is used for attaching a large tray guide 261*c*. The threaded hole 256 is used for attaching the small tray guide 61*b* or the large tray guide 261*c* in the same manner as in FIGS. 6A and 6B.

A large tray section 201*c* in FIG. 7A is equivalent to one obtained by omitting the large guide frames 162*c* from the large tray section 101*c* depicted in FIG. 6B, but including large tray guides 261*c* each formed into an L-shape in sectional view so as to cover the area of the corresponding large guide frame 162*c*. Each large tray guide 261*c* is attached to the corresponding device frame 252 by screwing screws (not shown) down to the threaded holes 254 and 256. Incidentally, to attach a small tray section 101*b* to the printer unit 201*a*, the small tray guides 61*b* are attached to the device frames 252 only through the threaded holes 256 respectively in the same manner as in FIG. 6A.

The laser printer 301Y in FIG. 7B has a printer unit 301*a* having a configuration different from that of the printer unit 101*a* shown in FIGS. 6A and 6B. In each device frame 352 of the printer unit 301*a*, the threaded hole 154 provided in the lower bent surface in FIG. 6B is omitted, but only a threaded hole 356 is provided in a portion of the guide support surface corresponding to the large tray guide 361*c*.

A large tray section 301*c* in FIG. 7B is equivalent to one obtained by omitting the large guide frames 162*c* from the large tray unit 101*c* in FIG. 6B. Each large tray guide 361*c* is attached to the corresponding device frame 352 only through the threaded hole 356. Also when the small tray section 101*b* is attached to the printer unit 301*a*, each small tray guide 61*b* is attached to the corresponding device frame 352 through the threaded hole 356.

Incidentally, each tray guide also serves to bear the weight of the printing device 50 and so on. Accordingly, it is necessary to pay attention to the necessity that the large tray guides 361*c* have to have enough strength or rigidity to support the printing device 50 in comparison with the large tray guides 61*c* supported by the large guide frames 162*c* in FIG. 6B or the large tray guides 261*c* each having an L-shape in section in FIG. 7A.

Incidentally, the threaded hole 256 in FIG. 7A and the threaded hole 356 in FIG. 7B are used for attaching any one of the small tray guide 61*b* for guiding the small tray 6*b* and the large tray guide 261*c*, 361*c* for guiding the large tray 6*c*. However, in the same manner as in the first embodiment, the number of threaded holes used for attaching the small tray guide 61*b* is smaller than the number of threaded holes used for attaching the large tray guide 261*c*, 361*c* (see FIGS. 4A and 4B). That is, the threaded holes for the small tray guide 61*b* are included in the threaded holes for the large tray guide 261*c*, 361*c*.

As described above, the printer unit 201*a*, 301*a* does not include any storage tray as its constituent component, but has the threaded holes 254, 256, 356 such that the small tray 6*b* and the large tray 6*c* having storage capacities different from each other can be selectively mounted to the printer unit 201*a*, 301*a*. Accordingly, only by attaching the small tray 6*b* or the large tray 6*c* to the printer unit 201*a*, 301*a*, it is possible to provide laser printers for a plurality of models different only in the paper storage capacity of the tray while curbing the cost. That is, in the same manner as in the first embodiment, it is possible to realize laser printers to which the trays 6*b* and 6*c* having various storage capacities can be removably attached in accordance with the need of users in spite of easiness in design or molding and reduction in cost.

In addition, when the small tray section 101*b* or the large tray section 201*c*, 301*c* is attached to the printer unit 201*a*, 301*a*, each tray guide 61*b*, 261*c*, 361*c* is attached to the corresponding device frame 252, 352. Due to such a configuration, each tray guide 61*b*, 261*c*, 361*c* is supported by the device frame 252, 352. Accordingly, the small guide frames 62*b* (see FIG. 1B) or the large guide frames 62*c* (see FIG. 3B) used in the first embodiment are dispensable. Thus, it is possible to obtain an effect in which the embodiment is advantageous in securing rigidity in the printer unit 201*a*, 301*a*.

In addition, since the threaded holes for the small tray guides 61*b* are included in the threaded holes for the large tray guides 261*c*, 361*c*, the work for attaching the tray guides when the laser printer is manufactured is easier than in the case where the threaded holes for the small tray guides 61*b* are provided separately from the threaded holes for the large tray guides 261*c*, 361*c*.

The preferred embodiments of the invention have been described above. However, the invention is not limited to the embodiments, but various changes in design can be made on the invention without departing from the claimed scope thereof.

For example, although two trays having different paper storage capacities, that is, the small tray 6*b* and the large tray 6*c* can be removably attached in the embodiments, the invention is also applicable to the configuration in which three or more trays having different paper storage capacities can be removable attached.

In addition, the protrusion portion 56 provided in the lower bent surface of each device frame 52 so as to project downward in the vertical direction is dispensable.

The threaded holes for the small guide frames 62*b* are included in the threaded holes for the large guide frames 62*c* in the embodiments. In the modifications of the second embodiment, the threaded holes for the small tray guides 61*b* are included in the threaded holes for the large tray guides 261*c*, 361*c*. However, the invention is not limited to such configurations. For example, the threaded holes for the small tray guides 62*b* and the threaded holes for the large guide frames 62*c* may be provided individually, or the threaded holes for the small tray guides 61*b* and the threaded holes for the large tray guides 261*c*, 361*c* may be provided individually.

In addition, the attaching portions used for attaching guide frames or tray guides to device frames are not limited to threaded holes. Various configurations including concave and convex engagement portions may be provided.

In the embodiments, the cover 53, 153 is also included as a constituent component of the printer unit 1*a*, 101*a*, 201*a*, 301*a*, which is designed so that only the tray unit or the tray section under the printer unit is replaced without replacing the cover. However, the cover may be made long enough to cover the area of respective tray units to be mounted. On this occasion, the cover is replaced whenever any tray unit is replaced. Also in this case, laser printers having various paper storage capacities can be provided sharing the device frames 52, 152, 252, 352 and so on excluding the cover 53, 153.

In addition, the cover 153 may be divided into a part for the area of the printing device 50 and the other part for the area of the small tray unit 101*b* in the second embodiment shown in FIGS. 6A and 6B.

In addition, the paper supply roller 9 may not have to be provided in the printer unit 1*a*, 101*a*, 201*a*, 301*a*, which are examples of an image forming unit. In this case, however, paper supply rollers 9 must be provided for the trays 6*b* and 6*c* to be mounted on the printer unit 1*a*, 101*a*, 201*a*, 301*a*, respectively.

Although the embodiments have been described on the case where a laser printer is adopted as an example of an image forming apparatus according to the invention, the invention is also applicable to various image forming apparatuses including other printers of an inkjet type and the like, copying machines, facsimile machines, and so on.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. An image forming unit for forming an image on a recording medium supplied from a storage unit that stores the recording medium, the image forming unit comprising:

a feed roller that feeds the recording medium from the storage unit;

an image forming device that forms an image on the recording medium fed by the feed roller;

a plurality of device frames, each of the device frames being formed in a U-shape and comprising a plate-like member that is attached to the image forming device and two arm portions that extend at right angles away from the plate-like member, a lower arm portion of each of the device frames comprising a plurality of first attaching portions and a plurality of second attaching portions;

a discharge tray that is provided above the image forming device from which the recording medium being formed with the image thereon is discharged;

a discharge roller that discharges the recording medium being formed with the image onto the discharge tray, wherein the feed roller and the discharge roller are disposed at opposite sides with respect to the image forming device, wherein the device frames are configured to be selectively attached with one of a first storage unit and a second storage unit, the first storage unit comprising a plurality of first frames, each of the first frames being formed in a U-shape and comprising a guide member and two arm portions that extend at right angles away from the guide member, and a first storage tray which has a first storage capacity and is slidably attached to the guide members, and the second storage unit comprising a plurality of second frames, each of the second frames being formed in a U-shape and comprising a guide member and two arm portions that extend at right angles away from the guide member, and a second storage tray which has a second storage capacity that is larger than the first storage capacity, the second storage tray being slidably attached to the guide members of the second storage unit, and wherein the discharge roller discharges the recording medium in a same direction as a direction in which the first storage tray and the second storage tray slides out of the image forming unit;

wherein if the first storage tray is selected, the first attaching portions fixedly attach the lower arm portions of the device frames to upper arm portions of the first frames of the first storage unit; and if the second storage tray is selected, both the first attaching portions and the second attaching portions fixedly attach the lower arm portions of the device frames to upper arm portions of the second frames of the second storage unit.

2. The image forming unit according to claim 1, wherein the first storage unit further comprises a first cover that covers the first frame portions, and wherein the second storage unit further comprises a second cover that covers the second frame portions.

3. The image forming unit according to claim 1, wherein the first storage unit further comprises a first guide member that is supported by the first frame portions and guides the first storage tray, and wherein the second storage unit further comprises a second guide member that is supported by the second frame portions and guides the second storage tray.

4. The image forming unit according to claim 1, wherein the image forming device is located at a top of the image forming unit.

5. The image forming unit according to claim 1, wherein the first storage unit and the second storage unit are located below the image forming device.

6. The image forming unit according to claim 1, wherein a height of the first frame portions is substantially equal to a height of the first storage tray and a height of the second frame portions is substantially equal to a height of the second storage tray.

7. An image forming apparatus comprising:

an image forming device that forms image on a recording medium;

a plurality of device frames, each of the device frames being formed in a U-shape and comprising a plate-like member that is attached to the image forming device and two arm portions that extend at right angles away from the plate-like member, a lower arm portion of each of the device frames comprising a plurality of first attaching portions and a plurality of second attaching portions;

a discharge tray that is provided above the image forming device from which the recording medium having the image formed thereon is discharged, a first storage unit that comprises a plurality of first frames, each of the first frames being formed in a U-shape and comprising a guide member and two arm portions that extend at right angles away from the guide member, and a first storage tray which has a first storage capacity and is slidably attached to the guide members; and a second storage unit that comprises a plurality of second frames, each of the second frames being forming in a U-shape and comprising a guide member and two arm portions that extend at right angles away from the guide member, and a second storage tray which has a second storage capacity that is larger than the first storage capacity, the second storage tray being slidably attached to the guide members of the second storage unit, wherein the device frames are configured to be selectively attached with one of a first storage unit and a second storage unit, and wherein if the first storage unit is selected, the first attaching portions fixedly attach the lower arm portions of the device frames to upper arm portions of the first frames of the first storage unit, and if the second storage unit is selected, both the first attaching portions and the second attaching portions fixedly attach the lower arm portions of the device frames to upper arm portions of the second frames of the second storage unit.

8. The image forming unit according to claim 7, wherein a height of the first frame portions is substantially equal to a height of the first storage tray and a height of the second frame portions is substantially equal to a height of the second storage tray.

9. A image forming apparatus comprising;

an image forming device that forms an image on a recording medium;

two device frames, one on each side of the image forming device, each of the device frames being formed in a U-shape and comprising a plate-like member that is attached to the image forming device and two arm portions that extend at right angles away from the plate-like member, a lower arm portion of each of the two device frames comprising a plurality of first attaching portions and a plurality of second attaching portions;

a discharge tray that is provided above the image forming device from which the recording medium having the image formed thereon is discharged;

a first storage unit that comprises two first frames, one on each side of the first storage unit, each of the first frames being formed in a U-shape and comprising a guide member and two arm portions that extend at right angles away from the guide member, and a first storage tray which has a first storage capacity and is slidably attached to the guide members; and a second storage unit that comprises two second frames, one on each side of the first storage unit, each of the second frames being forming in a U-shape and comprising a guide member and two arm portions that extend at right angles away from the guide member, and a second storage tray which has a second storage capacity that is larger than the first storage capacity, the second storage tray being slidably attached to the guide members of the second storage unit, wherein the device frames are configured to be selectively attached with one of a first storage unit and a second storage unit, and wherein if the first storage unit is selected, the first attaching portions fixedly attach the lower arm portions of the device frames to upper arm portions of the first frames of the first storage unit, and if the second storage unit is selected, both the first attaching portions and the second attaching portions fixedly attach the lower arm portions of the device frames to upper arm portions of the second frames of the second storage unit.

* * * * *